US008841853B2

(12) United States Patent
Ulmann et al.

(10) Patent No.: US 8,841,853 B2
(45) Date of Patent: Sep. 23, 2014

(54) LIGHTING SYSTEM, ELECTRONIC DEVICE FOR A LIGHTING SYSTEM AND METHOD FOR OPERATING THE ELECTRONIC DEVICE

(75) Inventors: Matthias U. Ulmann, Moosburg (DE); Milan Marjanovic, Ottobrunn (DE)

(73) Assignee: Texas Instruments Deutschland GmbH, Freising (DE)

( * ) Notice: Subject to any disclaimer, the term of this patent is extended or adjusted under 35 U.S.C. 154(b) by 345 days.

(21) Appl. No.: 13/343,776

(22) Filed: Jan. 5, 2012

(65) Prior Publication Data

US 2012/0187857 A1 Jul. 26, 2012

(30) Foreign Application Priority Data

Jan. 6, 2011 (DE) ..... 10 2011 007 990

(51) Int. Cl.
*H05B 37/02* (2006.01)
*H05B 33/08* (2006.01)

(52) U.S. Cl.
CPC ..... *H05B 33/0815* (2013.01)
USPC ..... 315/219; 315/308

(58) Field of Classification Search
CPC .... H05B 37/02; H05B 33/08; H05B 33/0803; H05B 33/0896; H02M 1/14; H02M 1/143
USPC ..... 315/209 R, 219, 227 R, 291, 307, 308
See application file for complete search history.

(56) References Cited

U.S. PATENT DOCUMENTS

| | | | | |
|---|---|---|---|---|
| 7,145,295 | B1 * | 12/2006 | Lee et al. | 315/291 |
| 7,843,146 | B2 * | 11/2010 | Chang Chien et al. | 315/291 |
| 2009/0230880 | A1 * | 9/2009 | Wang et al. | 315/294 |
| 2010/0090618 | A1 | 4/2010 | Veltman | |
| 2010/0207536 | A1 | 8/2010 | Burdalski et al. | |
| 2010/0213857 | A1 | 8/2010 | Fan | |
| 2010/0231136 | A1 | 9/2010 | Reisenauer et al. | |
| 2011/0101877 | A1 * | 5/2011 | Zhan et al. | 315/206 |

OTHER PUBLICATIONS

DE Search Report mailed Oct. 25, 2011.

* cited by examiner

*Primary Examiner* — Thuy Vinh Tran
(74) *Attorney, Agent, or Firm* — William B. Kempler; Frederick J. Telecky, Jr.

(57) ABSTRACT

An electronic device for a lighting system, comprising a TRIAC dimmer configured to receive a mains supply voltage and provide a phase cut voltage to the electronic device and having a control loop configured to control a duty cycle of a switched voltage converter that receives the rectified input voltage and provides drive current to a light emitting semiconductor device. The control loop has an error amplifier that is coupled to receive a sense voltage that is indicative of a current through the light emitting semiconductor device, the error amplifier is configured to provide a feedback signal to a pulse width modulation logic configured to control the duty cycle of the switched voltage converter to provide a constant drive current to the light emitting semiconductor device in response to the sense voltage, the error amplifier being coupled to receive a reference voltage that is a function of the input voltage.

11 Claims, 7 Drawing Sheets

LIGHTING SYSTEM, ELECTRONIC DEVICE FOR A LIGHTING SYSTEM AND METHOD FOR OPERATING THE ELECTRONIC DEVICE

CROSS-REFERENCE TO RELATED APPLICATIONS

This patent application claims priority from German Patent Application No. 10 2011 007 990.4, filed Jan. 6, 2011, which is incorporated herein by reference in its entirety.

FIELD OF THE INVENTION

The invention relates to a lighting system comprising a TRIAC dimmer, an electronic device for the lighting system and further to a method for operating the electronic device.

BACKGROUND OF THE INVENTION

In a conventional halogen lighting system as schematically and exemplarily illustrated in the upper part of FIG. 1, a halogen bulb 2 or a plurality of halogen bulbs is/are connected via an AC/AC transformer 4 to a mains supply having a voltage of typically 230 V at 50 Hz in Europe and 110 V at 60 Hz in the U.S. If a classical iron core transformer 4 is used, the turns ratio is adapted to the mains voltage so as to provide 12 V AC to the halogen bulb 2. Since classical transformers are large and heavy due to the iron core and copper windings, so-called electrical transformers which are small primary switched AC/AC converters are preferably used in modern halogen systems.

To vary the brightness of the halogen bulb 2, a TRIAC dimmer 6 is placed on the primary side of the transformer 4. The TRIAC dimmer 6 cuts the leading or trailing edge (depending on the type of the transformer) of the sinusoidal mains voltage as illustrated by the inset a) and b) in FIG. 1. Consequently, the RMS input voltage at the transformer 4 is reduced. This reduced voltage is subsequently transferred to the secondary side of the transformer 4 where it is applied to the halogen bulb 2. As halogen bulbs are almost ideal resistive loads, the RMS power is reduced and thereby the brightness of the halogen bulb 2. Alternatively, the TRIAC dimmer may be placed on the secondary side of the transformer 4, the functionality is the same as already explained.

Light emitting semiconductor devices, especially light emitting diodes (LEDs) are more and more used in lighting systems due to their low power consumption and low operating temperature. A schematic LED system is shown in the lower part of FIG. 1. An AC/AC transformer 4 is connected to the mains supply and since the LEDs 8 need a direct current, an additional LED driver 10 is placed on the secondary side of the transformer 4. A typical LED driver 10 comprises a current mode boost controller for driving a switched voltage converter, e.g. a boost-, buck- or sepic-converter (single ended primary inductance converter). A suitable controller 10 is e.g. the TPS40210 or TPS40211 controllers from Texas Instruments. The LED driver is configured to supply a constant current to the LEDs 8. This current is in general independent from the input and output voltage since an LED is controlled by current and not by voltage. The controller adjusts the duty cycle of the switched voltage converter in such a way that the output current of the LED driver 10 remains at a predetermined fixed value.

To provide the LED lighting system with a dimming capability, an external dimming signal DIM is needed. This dimming signal DIM has to be generated by an additional circuit, e.g. a dimming microcontroller 12, and has to be coupled to a feedback line of the LED driver 10. Typically, a high frequency (e.g. 1 kHz) is applied to the LED driver 10 and for dimming purpose. The LED is switched on and off using the aforementioned high frequency to prevent any flickering which could be seen by human eyes. Typically, when the dimming signal DIM is in a high state, the voltage seen by the LED driver 10 on a feedback pin is higher than an internal reference voltage and accordingly the LED driver 10 stops switching. The output current provided to the LEDs 8 is zero and the LED is not working anymore. If the dimming signal DIM is in low state, the LED driver 10 is not influenced and accordingly it provides a constant current to the LEDs 8. Depending on the duty cycle of the applied dimming signal DIM, the average output current of the LED driver 10 and accordingly the luminance of the LEDs 8 is changed. However, there is a need for a dimming signal DIM. Consequently, a dimming microcontroller and an additional line is necessary too.

SUMMARY OF THE INVENTION

It is a general object of the invention to provide a lighting system, an electronic device for the lighting system and a method for operating the electronic device, wherein the lighting system comprises a TRIAC dimmer and provides a phase cut voltage to the electronic device as an input voltage, wherein the electronic device shall be configured in that dimming of LEDs may be controlled by the phase cut voltage of the TRIAC dimmer.

In one aspect of the invention, an electronic device for a lighting system is provided, wherein the lighting system comprises a TRIAC dimmer and is further configured to receive a mains supply voltage and to provide a phase cut voltage to the electronic device. The electronic device comprises: a control loop that is configured to control a duty cycle of a switched voltage converter that receives the rectified phase cut voltage as an input voltage and provides a drive current to a light emitting semiconductor device. The control loop comprises an error amplifier that is coupled to receive a sense voltage that is indicative to a current through the light emitting semiconductor device. The error amplifier is configured to provide a feedback signal to a pulse width modulation logic that is configured to control the duty cycle of the switched voltage converter so as to provide a constant drive current to the light emitting semiconductor device in response to the sense voltage. The error amplifier is coupled to receive a reference voltage that is a function of the input voltage.

An LED is controlled by current and not by voltage. Consequently, when changing the input voltage, a typical LED driver adjusts the duty cycle of the switched voltage converter so as to provide an output current that remains at a predetermined fixed value. The output current is controlled by a closed loop that receives a feedback voltage that is defined by the current through the light emitting semiconductor device. The drive current is typically sensed by a fixed shunt resistor wherein the sense voltage is a voltage across a fixed shunt resistor. The sense voltage is compared to a reference voltage that is typically generated inside the LED driver and has a fixed value that cannot be changed.

If a TRIAC dimmer is used on the primary side of such an LED driver, the input current at the LED driver will increase due to the lower input voltage generated by the TRIAC dimmer. The output of the LED driver however stays constant and so the brightness of the LEDs. If the input current of the LED driver is further reduced by the TRIAC dimmer, at a certain point, the input current will exceed a predetermined threshold value and so the overcurrent protection of the LED driver stops operation of the switched voltage converter. Accordingly, the LEDs are switched off. After a short delay, the LED driver starts again, however, after restart, the overcurrent protection is activated again and stops the switched voltage converter. This leads to flickering of the LEDs but not to a reduced luminance as desired by the user that operates the TRIAC dimmer exactly for that purpose.

The electronic device according to the invention allows dimming of the LEDs within a lighting system using a TRIAC dimmer that reduces the RMS input voltage of an LED driver comprising the electronic device. Further, no additional feedback line and no electronic dimming logic providing a dimming signal to the LED driver are necessary. This is preferable when replacing a halogen bulb, preferably an MR16 halogen bulb in an existing lighting system comprising a TRIAC dimmer by an LED based system.

In principle, it could be an option to reduce the luminance of the LEDs by changing the value of the shunt resistor and thereby the feedback voltage that is indicative to the current through the LEDs. Due to the reduced feedback voltage, the LED driver would adjust the duty cycle and consequently the drive current and accordingly the luminance of the LEDs would sink too. However, in existing systems, the shunt resistors are typically fixed.

According to the invention, the reference voltage that is provided to the LED driver is changed. Preferably, the reference voltage is changed proportionally to the input voltage. In existing systems, the LED driver typically comprises an internal error amplifier that is coupled to a fixed internal reference voltage that is compared to the sense voltage. However, according to the invention, the error amplifier is coupled to a reference voltage that is a function of the input voltage. The input voltage is the rectified phase cut voltage provided by the TRIAC dimmer of the lighting system.

Further, a non inverting input of the error amplifier is coupled to the reference voltage and the inverting input is coupled to the sense voltage. The function between the input voltage and the reference voltage is defined by a voltage divider. The current through the light emitting semiconductor device is sensed by a fixed shunt resistor. The sense voltage is a voltage across this shunt resistor. The voltage divider allows an adjustment of the reference voltage to achieve a maximum average output current at a maximum input voltage.

Further, the input voltage that is coupled to the non-inverting input of the error amplifier as a reference voltage is filtered by a low pass filter that removes noise and spikes from the reference signal. The input voltage is further limited to a predetermined maximum voltage, a maximum voltage of the error amplifier.

According to an embodiment of the invention, the output terminal of the error amplifier is coupled to a load which decreases the noise sensitivity of the output signal of the error amplifier. According to another embodiment, a DC path is present between the inverting input of the error amplifier that is coupled to the reference voltage and the output of the error amplifier. This DC path further decreases the sensitivity of the electronic device with respect to noise.

The electronic device has a small bandwidth, preferably a bandwidth lower than 2 Hz. According to an embodiment of the invention, the electronic device comprises a compensation network defining the low bandwidth of preferably lower than 2 Hz. Further, the error amplifier may be an operational amplifier, preferably a rail-to-rail type operational amplifier. The low bandwidth of 2 Hz is lower than the frequency of the mains supply of typically 50 to 60 Hz. The low bandwidth of the electronic device allows achieving an average output current of exemplarily 700 mA. The output current is further preferably adjusted by the voltage divider defining the function between the input voltage and the reference voltage.

According to another aspect of the invention, a method for operating an electronic device is provided. The electronic device is for a lighting system comprising a TRIAC dimmer that is configured to receive a mains supply voltage and to provide a phase cut output voltage to the electronic device which receives the phase cut voltage as an input voltage. The method comprises the steps of: receiving a phase cut voltage from the TRIAC dimmer, rectifying the phase cut voltage to provide a rectified input voltage, converting the input voltage with a switched voltage converter so as to provide a drive current to the light emitting semiconductor device. Further, the method comprises the steps of: receiving a sense voltage that is indicative to a current through the light emitting semiconductor device at an error amplifier, coupling an output signal of the error amplifier as a feedback signal to a pulse width modulation logic that is a part of the control loop of the electronic device and that is configured to control a duty cycle of the switched voltage converter so as to provide a constant drive current to the light emitting semiconductor device in response to the sense voltage. According to further steps of the method, a reference voltage is coupled to the error amplifier wherein the reference voltage is a function of the input voltage. Further, an updated feedback signal is provided to the pulse width modulation logic to vary a duty cycle of the switched voltage converter so as to provide an updated constant drive current to the light emitting semiconductor device in response to the sense voltage and the reference voltage.

In another aspect of the invention, a lighting system comprising a TRIAC dimmer that is configured to receive a mains supply voltage and to provide a phase cut voltage to an electronic device is provided. The electronic device provides a drive current to a light emitting semiconductor device and is in conformity with the aforementioned electronic device according to the invention.

Same or similar advantages that have been already mentioned for the electronic device according to the invention also apply to the method for operating the electronic device and to the lighting system according to the invention.

BRIEF DESCRIPTION OF DRAWINGS

Further aspects of the invention will appear from the appending claims and from the following detailed description given with reference to the appending drawings.

DETAILED DESCRIPTION OF EXAMPLE EMBODIMENTS

Figure 1:
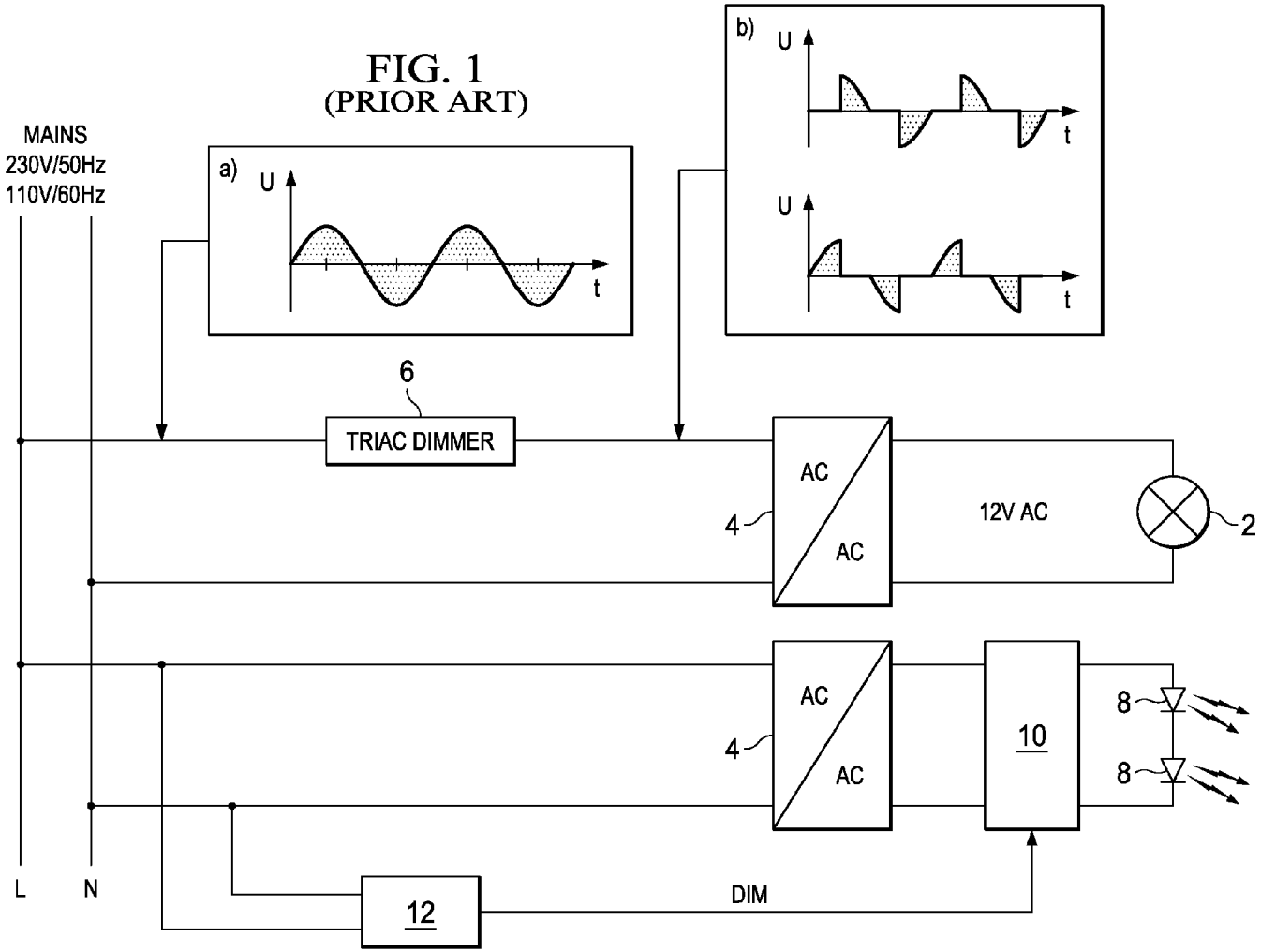
FIG. 1 (PRIOR ART)
FIG. 1 is a lighting system comprising a halogen bulb and a further lighting system comprising an LED chain, according to the art.
Figure 2:
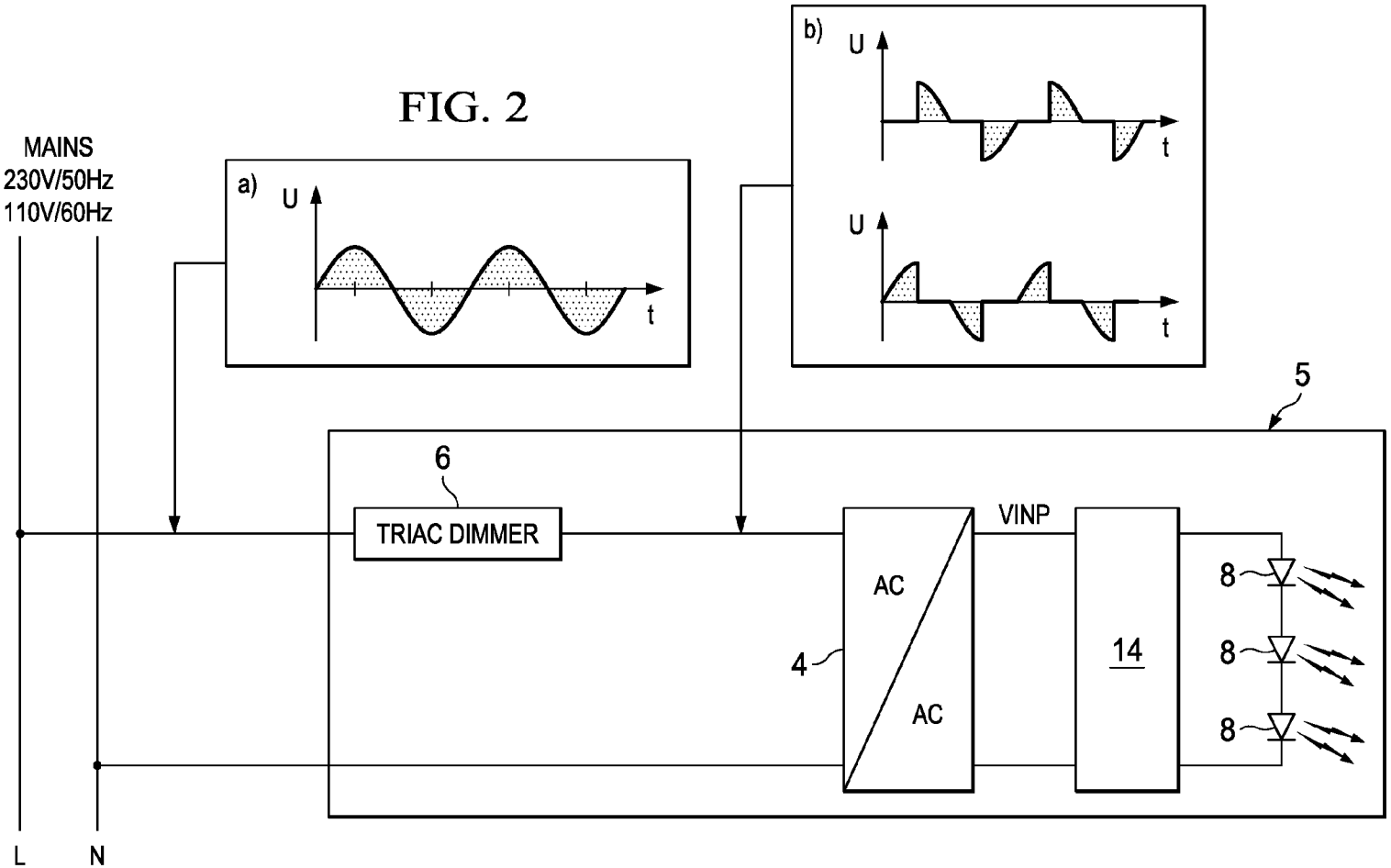
FIG. 2 is an LED based lighting system according to an embodiment of the invention comprising an electronic device according to an embodiment of the invention.

FIG. 2 is an LED based lighting system 5 according to an embodiment of the invention. A TRIAC dimmer 6 cutting the leading or the trailing edge of a sinusoidal primary supply voltage of 230 V at 50 kHz in Europe or 110 V at 60 Hz in the U.S. is coupled to the primary side of an AC/AC transformer 4. The transformer 4 may be a classical iron core or an electronic transformer. The cut output voltage of the TRIAC dimmer 6 is schematically illustrated by the insets a) and b) in FIG. 2. At the secondary side of the transformer 4, an electronic device 14 according to an embodiment of the invention receives the phase cut voltage as an input voltage and provides a supply voltage to the LED chain 8.

Figure 3:
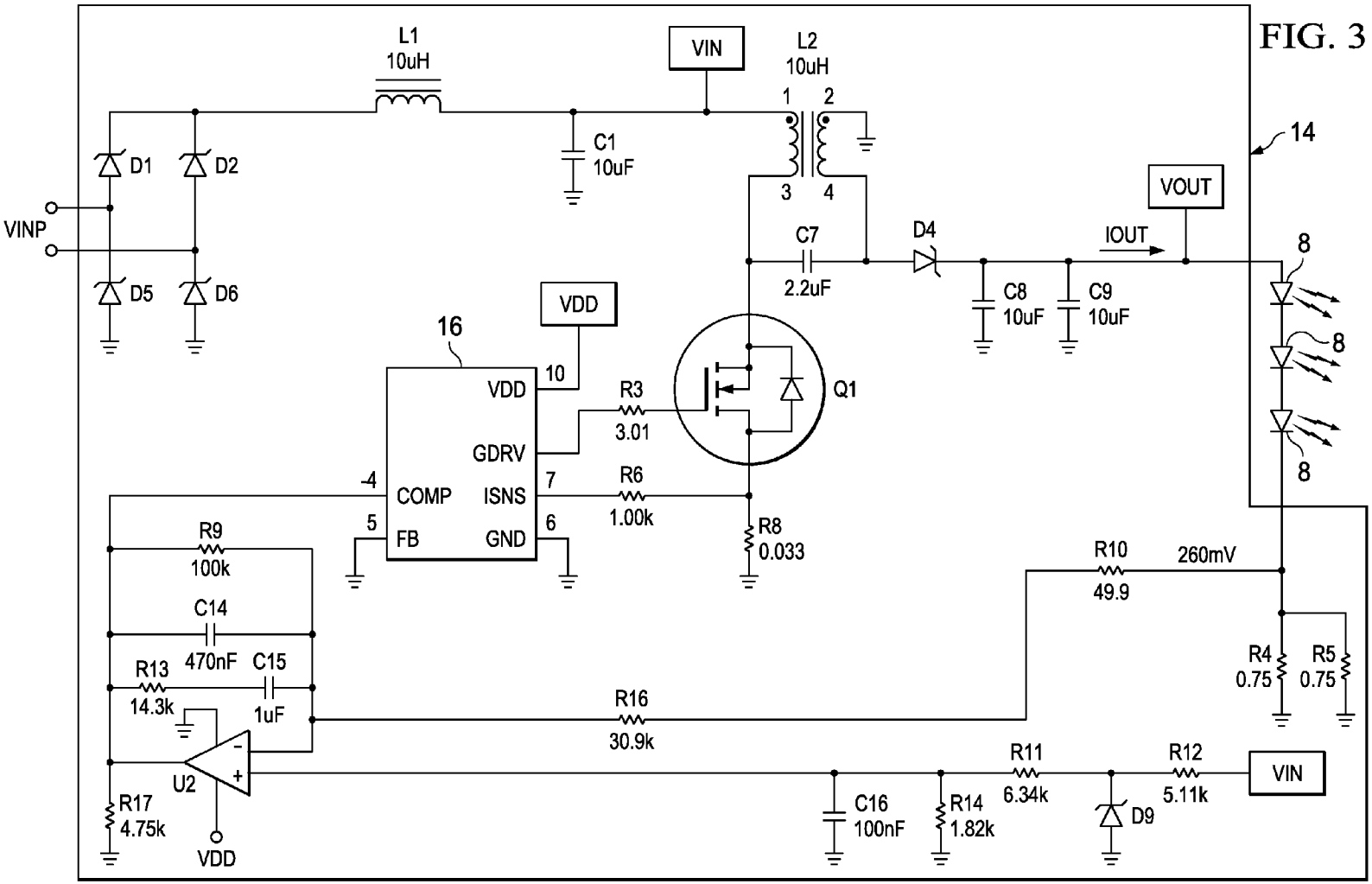
FIG. 3 is a detailed view of the electronic device of FIG. 2.

FIG. 3 is a detailed view of the electronic device 14. A phase cut input voltage VINP is provided to a rectifier comprising diodes D1, D2, D5 and D6. The rectified voltage is smoothed by a low pass filter comprising the inductance L1 of 10 μH, for example, and capacitor C1 of 10 μF, for example. The rectified and smoothed phase cut voltage VINP is the input voltage VIN. The input voltage VIN is coupled to the SEPIC converter and to the non-inverting input of the operational amplifier U2. A controller 16, of the type: TPS40210 or TPS40211 controllers of Texas Instruments, for example, provides a gate driver signal GDRV to the gate of a power switch Q1 of a switched voltage converter. According to the embodiment of FIG. 3, a SEPIC type voltage converter is used that is a voltage converter providing boost-and/or buck-converter functionality. The voltage converter comprises the inductance L2 of 10 μH, for example, the capacitor C7 of 2.2 μF, for example, the diode 4 and the capacitances C8 and C9 of 10 μF, each for example. A controller 16 controls the duty cycle of the switch Q1 and thereby provides a constant output current having a voltage of VOUT to the LED chain 8. The current at the switch Q1 is sensed by input ISNS of the controller 16 that also provides an overcurrent protection.

The current through the LED chain 8 is sensed by the shunt resistors R4 and R5 of 0.75Ω each, for example. At a constant LED drive current of 693 mA, the feedback voltage at the shunt resistors is 260 mV. This voltage is coupled to the inverting input of the operational amplifier U2. The non inverting input is coupled to the input voltage VIN. The operational amplifier U2 acts as an error amplifier and is supplied by the same supply voltage VDD as the controller 16.

Between the inverting input and the output of the operational amplifier U2 a DC path is provided by resistor R9 of 100Ω, for example. This DC path prevents charging of the capacitors C14 and C15 of, for example, 470 nF and 1 μF, respectively. The compensation network comprising R9, C14, R13 and C15 increases the stability and defines a bandwidth of the electronic device that is, for example, lower than 2 Hz. Further, the output of operational amplifier U2 is coupled to a load resistor R17 of 4.75 k Ω, for example. This decreases noise sensitivity of the output/feedback signal of the operational amplifier U2 that is coupled to the COMP input of the controller 16.

Figure 4:
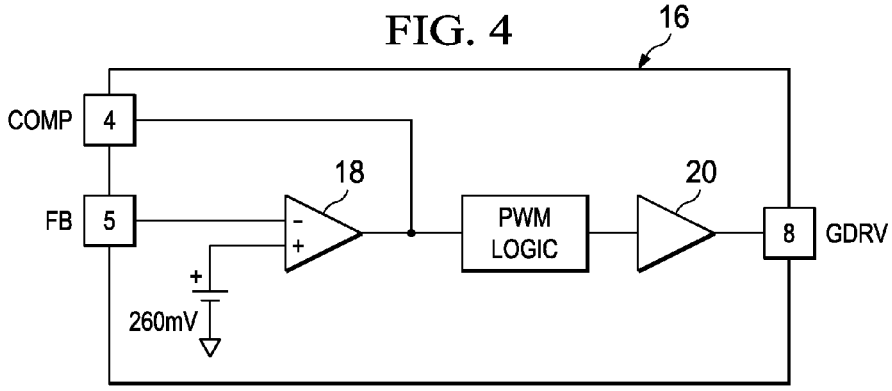
FIG. 4 is a further detailed view of a controller that is a part of the electronic device of FIG. 3.

FIG. 4 is a schematic detailed view of the controller 16 which can be a TPS40210 or TPS 40211 controller from Texas Instruments. The functionality of the controller 16 is illustrated with respect to the COMP and FB-pin (feedback-pin) and further with respect to the influence of the COMP and FB signal on the gate driver signal GDRV. Further parts of the controller 16 are not shown. The controller 16 comprises an internal error amplifier 18 that is connected to a fixed internal reference voltage of 260 mV at its non inverting input. The feedback pin FB is connected to the inverting input of the operational amplifier 18 acting as an error amplifier. The output signal of the operational amplifier 18 is coupled to a pulse width modulation logic PVMLOGIC that generates a pulse width modulated signal that is subsequently coupled to a driver 20. The driver 20 provides a gate drive signal GDRV to the gate of the switch Q1 (see FIG. 4).

The internal error amplifier 18 of controller 16 cannot be removed and further, it is coupled to a fixed internal reference voltage of 260 mV. According to the invention, it is desired to provide an error amplifier that is coupled to a reference voltage that is a function of the input voltage VIN. Since the error amplifier 18 cannot be removed, it is wired as a buffer i.e. the FB-pin is connected to ground (see FIG. 4). Accordingly, no further regulation is performed by the error amplifier. The controller 16, i.e. the PWMLOGIC is directly controlled by the COMP pin. If the input voltage VIN at the error amplifier U2 is set to 260 mV, the functionality of the electronic device in FIG. 4 would be exactly the same as it is known from the driver of the TPS40210 or TPS40211 controllers.

However, the input voltage VIN is not constant over time but varies as a function of the phase cut input voltage VINP provided by the TRIAC dimmer to the electronic device in FIG. 3. The input voltage VIN that is coupled to the non-inverting input of the operational amplifier U2 is limited by the zener diode D9. This avoids flickering when the input voltage VIN changes slightly due to normal tolerances in the mains voltage. Afterwards, the input voltage VIN is divided by the voltage divider comprising resistor R11 of 6.34 k Ω and resistor R14 of 1.82 k Ω, for example. The voltage divider is adjusted to achieve a maximum average output current at a maximum input voltage. Further, capacitor C16 of 100 nF, for example, acts as a low pass filter and removes noise and spikes from the input voltage VIN. When the input voltage VIN changes, e.g. due to a change of the TRIAC dimmer, the output current at the LED chain 8 follows since the input voltage VIN acts as a reference voltage at the operational amplifier U2. The output signal of the operational amplifier U2 causes the PWMLOGIC to change the duty cycle of the switched voltage converter via the gate driver signal GDRV that is coupled to the gate of the switch Q1.

In the following, exemplary measurements for an electronic device according to an embodiment of the invention will be explained. An electronic device 14 (see FIG. 3) is provided with an alternating input voltage VINP of 12V. The rectifier (D1, D2, D5, D6) rectifies this input voltage VINP in order to omit negative input voltages. In the upper half of FIG. 5, the time dependent voltage signal for this rectified input voltage VINR is depicted. In the lower half of FIG. 5, a time dependent output current IOUT that is generated by the electronic device 14 is depicted. For the measurement in FIG. 5, no TRIAC dimmer is present in the lighting system 5 (see FIG. 2). The average output current IOUT is adjusted by the voltage divider consisting of R11/R14 (see FIG. 3). The peak output current IOUT is about 1300 mA, however, the average output current is regulated to about 700 mA.

Figure 6:
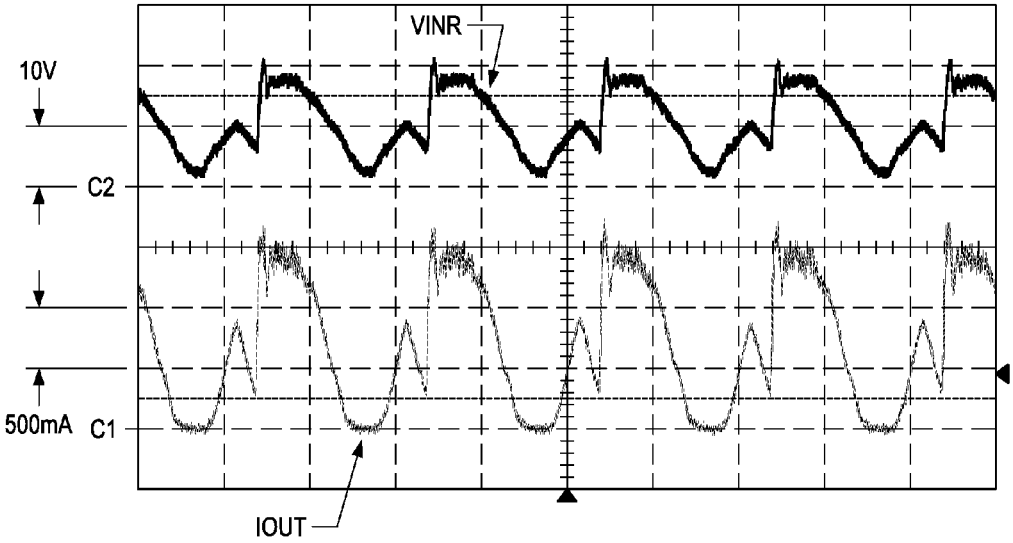

For the measurement of FIG. 6, a TRIAC dimmer is inserted on the primary side of the AC/AC converter 4 (see FIG. 2). Although the TRIAC dimmer is at 100% duty cycle, the rectified input voltage VINR is already cut. Again, resistors R11/R14 are adjusted to achieve a maximum average output current of exemplarily 700 mA. The output current IOUT follows exactly the input voltage VINR.

Figure 7:
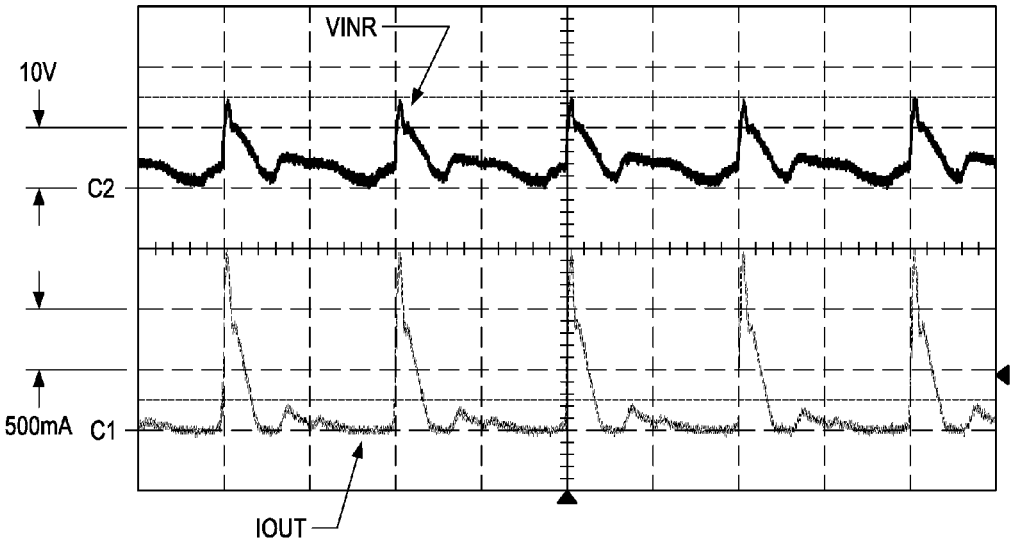

In FIG. 7, a further measurement using a TRIAC dimmer is shown. In comparison to FIG. 6, the TRIAC dimmer is set to a lower duty cycle, as indicated by the rectified input voltage VINR. Consequently, the average output current is 170 mA. Again, the output current IOUT follows the input voltage VINR exactly. The output current IOUT and the brightness of the LED chain 8 is changed due to the changed duty cycle of the TRIAC dimmer 6.

Figure 5:
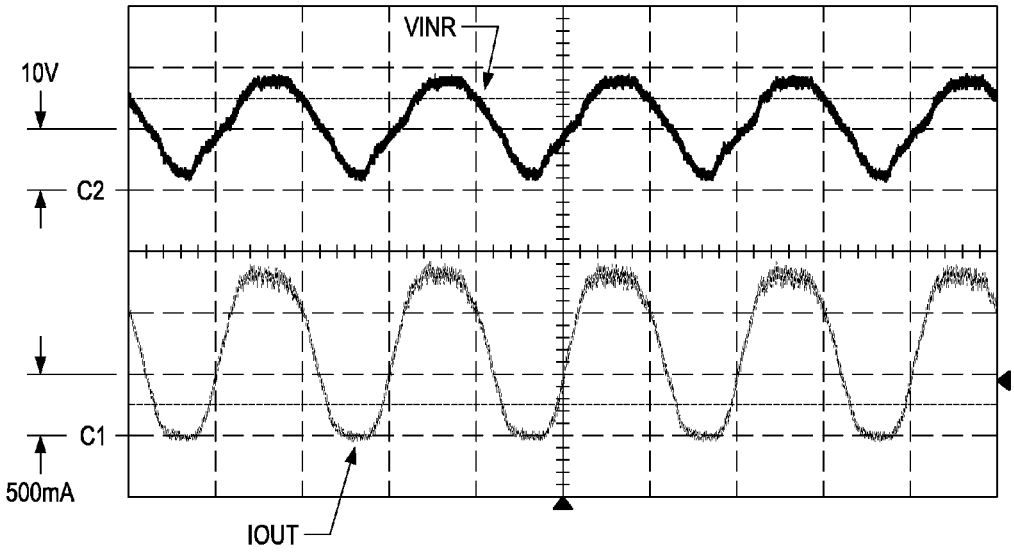
FIGS. 5 to 10 are a time dependent signals for an input voltage and an output current of an electronic device according to an embodiment of the invention.
Figure 8:
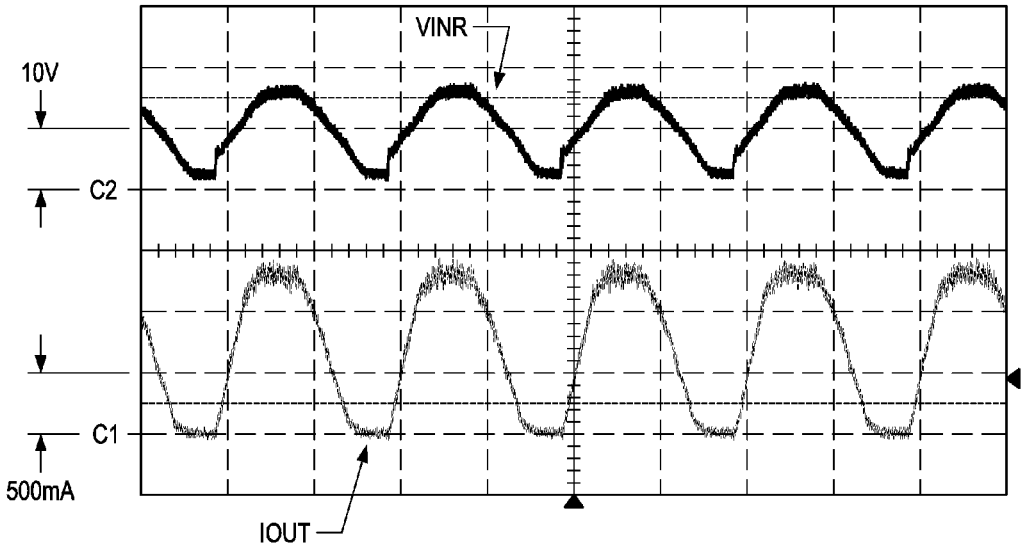
Figure 9:
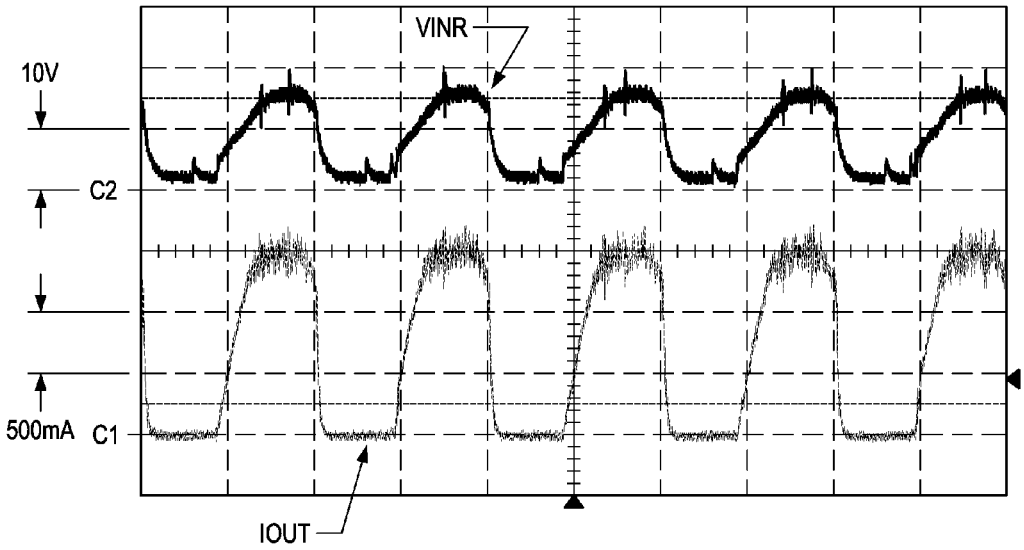
Figure 10:
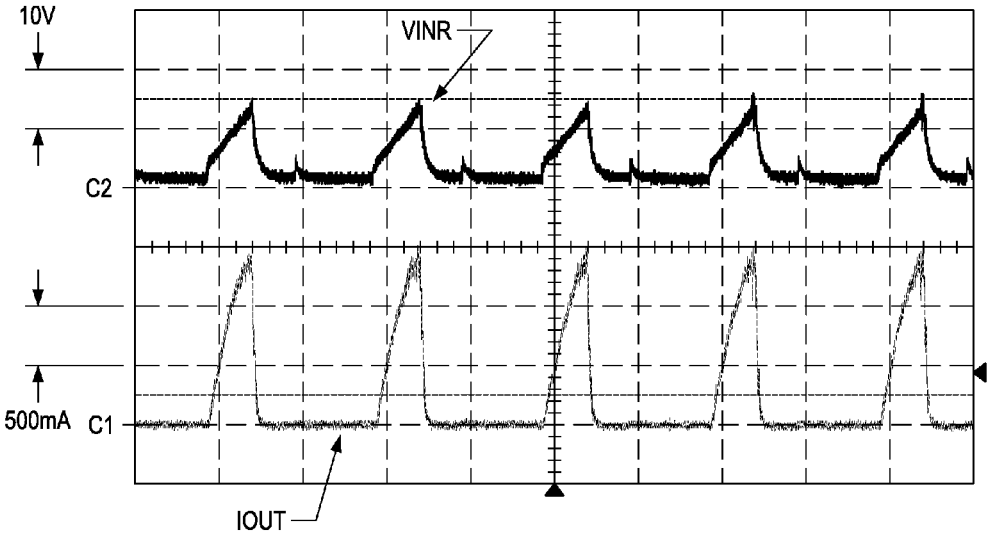

While FIGS. 5 to 7 are measurements using a classical iron core transformer 4, FIGS. 8 to 10 are corresponding further measurements using an electronic transformer 4. Consequently, FIG. 8 corresponds to FIG. 5, no TRIAC is present in the lighting system; FIG. 9 corresponds to FIG. 6, the TRIAC works at 100% duty cycle and FIG. 10 corresponds to FIG. 7, the TRIAC works with a reduced duty cycle. The behavior of the LED driver is almost the same, small spikes in the rectified input voltage VINR are filtered by the capacitor C16.

Although the invention has been described in detail, it should be understood that various changes, substitutions and alterations can be made thereto without departing from the spirit and scope of the invention as defined by the appended claims.

The invention claimed is:

1. An electronic device for a lighting system, wherein the lighting system comprises a TRIAC dimmer and is configured to receive a mains supply voltage and to provide a phase cut voltage to the electronic device, wherein the electronic device comprises:

a control loop that is configured to control a duty cycle of a switched voltage converter that receives a rectified phase cut voltage as an input voltage and provides a drive current to a light emitting semiconductor device, the control loop comprises an error amplifier that is coupled to receive a sense voltage that is indicative to a current through the light emitting semiconductor device, the error amplifier being configured to provide a feedback signal to a pulse width modulation logic that is configured to control the duty cycle of the switched voltage converter so as to provide a constant drive current to the light emitting semiconductor device in response to the sense voltage and the error amplifier being coupled to receive a reference voltage that is a function of the input voltage, wherein a DC path is present between the inverting input of the error amplifier that is coupled to the reference voltage and an output terminal of the error amplifier.

2. The electronic device according to claim 1, wherein a non-inverting input of the error amplifier is coupled to the reference voltage and the inverting input is coupled to the sense voltage.

3. The electronic device according to claim 1, wherein the function between the input voltage and the reference voltage is defined by a voltage divider.

4. The electronic device according to claim 1, wherein the current through the light emitting semiconductor device is sensed by a fixed shunt resistor and the sense voltage is a voltage across the shunt resistor.

5. The electronic device according to claim 1, wherein the input voltage that is coupled to the non-inverting input of the error amplifier as a reference voltage is filtered by a low-pass filter and is limited to a predetermined maximum voltage.

6. The electronic device according to claim 1, wherein an output terminal of the error amplifier that is providing the feedback signal is coupled to a load.

7. The electronic device according to claim 1, wherein the error amplifier is an operational amplifier.

8. The electronic device according to claim 1, wherein the error amplifier is a rail-to-rail type operational amplifier.

9. An electronic device for a lighting system, wherein the lighting system comprises a TRIAC dimmer and is configured to receive a mains supply voltage and to provide a phase cut voltage to the electronic device, wherein the electronic device comprises:

a control loop that is configured to control a duty cycle of a switched voltage converter that receives a rectified phase cut voltage as an input voltage and provides a drive current to a light emitting semiconductor device, the control loop comprises an error amplifier that is coupled to receive a sense voltage that is indicative to a current through the light emitting semiconductor device, the error amplifier being configured to provide a feedback signal to a pulse width modulation logic that is configured to control the duty cycle of the switched voltage converter so as to provide a constant drive current to the light emitting semiconductor device in response to the sense voltage and the error amplifier being coupled to receive a reference voltage that is a function of the input voltage, further comprising a compensation network that is configured to define a bandwidth of the electronic device that is substantially lower than 2 Hz.

10. A method for operating a an electronic device for a lighting system, wherein the lighting system comprises a TRIAC dimmer and is configured to receive a mains supply voltage and to provide a phase cut output voltage to the electronic device, the method comprising:

receiving a phase cut voltage from the TRIAC dimmer;

rectifying the phase cut voltage to provide a rectified input voltage;

converting the input voltage with a switched voltage converter so as to provide a drive current to a light emitting semiconductor device;

receiving a sense voltage that is indicative to a current through the light emitting semiconductor device at an error amplifier;

coupling an output signal of the error amplifier as a feedback signal to a pulse width modulation logic that is a part of a control loop of the electronic device and that is configured to control a duty cycle of the switched voltage converter so as to provide a constant drive current to the light emitting semiconductor device in response to the sense voltage;

coupling a reference voltage that is a function of the input voltage to the error amplifier;

providing a DC path between the inverting input of the error amplifier that is coupled to the reference voltage and an output terminal of the error amplifier; and providing an updated feedback signal to the pulse width modulation logic to vary a duty cycle of the switched voltage converter so as to provide an updated constant drive current to the light emitting semiconductor device in response to the sense voltage and the reference voltage.

11. A lighting system comprising a TRIAC dimmer that is configured to receive a mains supply voltage and to provide a phase cut voltage to an electronic device for providing a drive current to a light emitting semiconductor device, wherein the electronic device comprises:

a control loop that is configured to control a duty cycle of a switched voltage converter that receives the rectified input voltage and provides a drive current to the light emitting semiconductor device;

the control loop comprises an error amplifier that is coupled to receive a sense voltage that is indicative to the drive current through the light emitting semiconductor device;

the error amplifier is configured to couple a feedback signal to a pulse width modulation logic that is configured to control the duty cycle of the switched voltage converter so as to provide a constant drive current to the light emitting semiconductor device in response to the sense voltage;

the error amplifier is coupled to receive a reference voltage that is a function of the input voltage provided to the electronic device; and further comprising a compensation network that is configured to define a bandwidth of the electronic device that is substantially lower than 2 Hz.

* * * * *